US011303993B2

(12) United States Patent
Rusconi Clerici Beltrami et al.

(10) Patent No.: US 11,303,993 B2
(45) Date of Patent: Apr. 12, 2022

(54) SOUND TRANSDUCER UNIT FOR GENERATING AND/OR DETECTING SOUND WAVES IN THE AUDIBLE WAVELENGTH SPECTRUM AND/OR IN THE ULTRASONIC RANGE

(71) Applicant: USOUND GMBH, Graz (AT)

(72) Inventors: Andrea Rusconi Clerici Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 17/030,685

(22) Filed: Sep. 24, 2020

(65) Prior Publication Data

US 2021/0092509 A1 Mar. 25, 2021

(30) Foreign Application Priority Data

Sep. 25, 2019 (DE) ..... 10 2019 125 815.4

(51) Int. Cl.
*H04R 1/10* (2006.01)
*H04R 31/00* (2006.01)
*H04R 1/02* (2006.01)

(52) U.S. Cl.
CPC ..... *H04R 1/1091* (2013.01); *H04R 1/1016* (2013.01); *H04R 31/00* (2013.01); *H04R 2201/003* (2013.01); *H04R 2420/00* (2013.01)

(58) Field of Classification Search
CPC .... H04R 1/1091; H04R 1/1016; H04R 31/00; H04R 2201/003; H04R 2420/00
USPC ..... 381/74, 345
See application file for complete search history.

(56) References Cited

U.S. PATENT DOCUMENTS

| | | | | |
|---|---|---|---|---|
| 9,131,315 | B2 | 9/2015 | Mietta et al. | |
| 9,628,918 | B2 | 4/2017 | Ng | |
| 9,980,051 | B2 | 5/2018 | Clerici et al. | |
| 10,034,097 | B2 | 7/2018 | Clerici et al. | |
| 10,547,925 | B2 | 1/2020 | Kuki et al. | |
| 2009/0092274 | A1* | 4/2009 | Song | H04R 19/016 381/369 |

(Continued)

FOREIGN PATENT DOCUMENTS

| | | |
|---|---|---|
| DE | 10 2014 117 209 A1 | 5/2015 |
| DE | 10 2014 106 753 A1 | 11/2015 |

(Continued)

OTHER PUBLICATIONS

German Search Report and Translation, dated Jun. 24, 2020, 22 pages.
European Search Report dated Nov. 10, 2020, 9 pages.

*Primary Examiner* — Ammar T Hamid
(74) *Attorney, Agent, or Firm* — Dority & Manning, P.A.

(57) ABSTRACT

A sound transducer unit for an in-ear headphone, for generating and/or detecting sound waves in the audible wavelength spectrum and/or in the ultrasonic range, includes at least one MEMS sound transducer arranged on a circuit board. At least one connector element of the circuit board is electrically conductively connected to at least one contact element of the MEMS sound transducer. The MEMS sound transducer is designed as a surface-mount device, which is connected to the circuit board with the aid of surface-mount technology. The sound transducer unit can form a component of a sound-generating unit.

19 Claims, 5 Drawing Sheets

(56) References Cited

U.S. PATENT DOCUMENTS

| | | | | |
|---|---|---|---|---|
| 2013/0129119 | A1 | 5/2013 | Miyatake et al. | |
| 2013/0343564 | A1* | 12/2013 | Darlington | H04R 1/1083 381/74 |
| 2014/0103464 | A1 | 4/2014 | Bolognia et al. | |
| 2016/0241951 | A1 | 8/2016 | Minervini | |
| 2017/0215001 | A1 | 7/2017 | Harney et al. | |
| 2018/0179048 | A1* | 6/2018 | Schenk | H04R 17/00 |
| 2019/0149924 | A1* | 5/2019 | Cheng | H04R 7/122 381/412 |
| 2021/0076118 | A1* | 3/2021 | Struzik | H04R 1/1075 |

FOREIGN PATENT DOCUMENTS

| | | | |
|---|---|---|---|
| EP | 2566183 | A1 | 3/2013 |
| EP | 2587832 | A1 | 5/2013 |
| EP | 3209027 | A1 | 8/2017 |

* cited by examiner

SOUND TRANSDUCER UNIT FOR GENERATING AND/OR DETECTING SOUND WAVES IN THE AUDIBLE WAVELENGTH SPECTRUM AND/OR IN THE ULTRASONIC RANGE

FIELD OF THE INVENTION

The present invention relates to a sound transducer unit, in particular for an in-ear headphone, for generating and/or detecting sound waves in the audible wavelength spectrum and/or in the ultrasonic range, comprising a circuit board and at least one MEMS sound transducer arranged thereon, wherein at least one connector element of the circuit board is electrically conductively connected to at least one contact element of the MEMS sound transducer.

BACKGROUND OF THE INVENTION

DE 10 2014 016 753 A1 describes a sound transducer unit, which is arranged in a circuit board. The disadvantage thereof is that a manufacture of such a sound transducer unit is complex.

SUMMARY OF THE INVENTION

The object of the present invention is therefore to create a sound transducer unit, the manufacturing method of which is simplified.

The object is achieved by means of a sound transducer unit, its manufacturing method, and a mobile device having the features described below.

The invention relates to a sound transducer unit for generating and/or detecting sound waves in the audible wavelength spectrum and/or in the ultrasonic range. The sound transducer unit can therefore be operated as a loudspeaker and/or as a microphone. In the ultrasonic range, the sound waves can be utilized, for example, as a distance or proximity sensor. Furthermore, the sound transducer unit can be utilized, for example, for in-ear headphones, which are at least partially arranged in an ear canal. The sound transducer unit can also be utilized, however, for other sound-generating units, such as for smartphones, radios, televisions, PCs, etc.

The sound transducer unit comprises a circuit board and at least one MEMS sound transducer arranged thereon. The circuit board can comprise electrical lines or strip conductors, in order to conduct electric voltages, electric currents, and/or electrical signals. Furthermore, the MEMS sound transducer is utilized for generating and/or detecting sound waves in the audible wavelength spectrum and/or in the ultrasonic range. The circuit board is a support for the MEMS sound transducer in this case.

Furthermore, the circuit board comprises at least one connector element and the MEMS sound transducer comprises at least one contact element. Moreover, the at least one connector element is electrically conductively connected to the at least one contact element. One connector element is connected to one contact element in each case when several of each are present.

According to the invention, the MEMS sound transducer is designed as a surface-mount device, which is connected to the circuit board with the aid of surface-mount technology. Since the MEMS sound transducer is designed as a surface-mount device, it can be arranged on the circuit board with the aid of surface-mount technology. This is an assembly process that can be well automated. The manufacture of the sound transducer unit is simplified and accelerated as a result.

It is advantageous when the connector element and the contact element are electrically connected to one another with the aid of an integral connection. The connector element and the contact element can also be soldered to one another, so that a soldered connection is formed. As a result, a stable, electrically conductive connection is formed. Furthermore, the integral connection can hold the MEMS sound transducer on the circuit board in a self-contained manner or alone.

It is advantageous when the MEMS sound transducer comprises a diaphragm unit, which is coupled to a transducer element of the MEMS sound transducer. With the aid of the transducer element, which can comprise, for example, a piezoelectric actuator and/or a piezoelectric layer, deflections can be generated and/or detected. These deflections are transmitted onto the diaphragm unit with the aid of the coupling, for example, with the aid of a coupling element. Thereupon, the diaphragm unit generates sound. The diaphragm unit can also convert sound waves into deflections, however, which are transmitted onto the transducer element. The transducer element can generate the deflections from an electrical signal and/or the electrical signals from deflections.

Advantageously, the diaphragm unit or a diaphragm of the diaphragm unit is made of a heat-resistant diaphragm material. For example, polyimides, polyamides, or silicones can be utilized as heat-resistant diaphragm material. When the MEMS sound transducer is soldered onto the circuit board, the MEMS sound transducer and, therefore, also the diaphragm or the diaphragm unit, can heat up to or even above 300° C. Damage can be prevented with the aid of the heat-resistant diaphragm material.

It is advantageous when the MEMS sound transducer comprises a transducer support, wherein the MEMS sound transducer is arranged on the circuit board with the aid of the transducer support. The transducer support can be a support substrate. Furthermore, the transducer element, in particular the piezoelectric actuator and/or the piezoelectric layer, can be arranged on the transducer support. Additionally or alternatively, the diaphragm unit can be arranged at the transducer support.

Additionally or alternatively, it is advantageous when the transducer support comprises a first through-channel. With the aid of the first through-channel, a pressure, which arises when the diaphragm unit moves or is deflected, can be equalized.

It is advantageous when the at least one contact element is designed as a contact surface. As a result, the MEMS sound transducer can be more simply constructed.

Additionally or alternatively, it is advantageous when the at least one contact element is arranged at the transducer support. As a result, further components are dispensed with, so that the MEMS sound transducer or the sound transducer unit is compactly designed. For example, the transducer support can comprise the at least one contact surface, which is preferably arranged at an outer or peripheral side of the transducer support.

Additionally or alternatively, it is advantageous when the transducer support comprises electrical lines for the transducer element. With the aid of these electrical lines, the electrical signals can be conducted to the transducer element or conducted away therefrom. The electrical lines can extend at an outer surface and/or in an interior of the transducer support.

It is advantageous when the circuit board comprises a second through-channel. This second through-channel can be coaxial and/or congruent with the first through-channel of the MEMS sound transducer. The pressure formed upon deflection of the diaphragm unit can therefore be equalized with the aid of the first and the second through-channels. The first and the second through-channels, together, form an equalizing channel. Furthermore, the first and the second through-channels, together, form a connection to a back volume of the sound transducer unit, wherein the acoustic properties of the sound transducer unit are determined with the aid of the back volume.

It is advantageous when the circuit board comprises a component side facing the MEMS sound transducer, onto which the MEMS sound transducer is placed in a contact region, so that the contact elements contact the connector elements. The circuit board can already comprise the contact regions, so that a manufacture of the sound transducer unit in large quantities is very simple. The contact region comprises the contact elements.

It is advantageous when the sound transducer unit comprises a printed wiring board, on which the circuit board comprising the MEMS sound transducer is arranged. The printed wiring board can be designed to be larger than the circuit board. The unit made up of the circuit board and the MEMS sound transducer is arranged on the printed wiring board. Furthermore, the printed wiring board comprises further electrical components, which are required for the operation of the sound transducer unit. In this way, the printed wiring board can comprise, for example, a control unit, an, in particular, wireless, interface, an energy unit, a memory unit, sensors, and/or an energy interface.

The printed wiring board can comprise strip conductors, as is also the case with the circuit board.

Advantageously, the circuit board can be arranged on the printed circuit board with the aid of spacers. A single spacer can also suffice. The at least one spacer is therefore arranged between the printed wiring board and the circuit board.

It is advantageous when at least one electrical plug connection is arranged between the circuit board and the printed wiring board, so that electrical signals can be conducted to the MEMS sound transducer and/or conducted away therefrom.

Additionally or alternatively, at least one spacer can also electrically connect the circuit board and the printed wiring board for exchanging electrical signals. The spacer(s) can be electrically conductive. Additionally or alternatively, strip conductors can also be arranged in at least one spacer, so that multiple conductors are routed through a spacer.

It is advantageous when the sound transducer unit comprises a transducer housing, in which at least the MEMS sound transducer and/or the circuit board are/is arranged. With the aid of the transducer housing, at least the MEMS sound transducer can be protected against dirt and damage.

It is advantageous when the transducer housing comprises a first coupling region for coupling an ear element onto the transducer housing. The ear element can be made up of a flexible material, for example, rubber. The ear element can be provided in order to be at least partially pushed into an ear canal when the sound transducer unit is utilized for an in-ear headphone. The ear element or also earplug can adapt to the ear canal.

Additionally or alternatively, it is advantageous when the transducer housing comprises a second coupling region for coupling a headphone unit to the transducer housing. The headphone unit can comprise, for example, a battery or an accumulator.

It is advantageous when the transducer housing comprises an exit opening for sound waves. If the transducer housing or the sound transducer unit is utilized for an in-ear headphone, the exit opening is directed in the direction of the ear canal or the tympanic membrane. The sound waves are therefore conducted directly to the ear.

In order to adapt the acoustic properties of the sound transducer unit, it is advantageous when the transducer housing comprises a front volume, which is arranged between the exit opening and the MEMS sound transducer.

It is advantageous when the transducer housing comprises a dust barrier and/or a moisture barrier. The dust barrier can be arranged in the area of the exit opening and/or the moisture barrier can be arranged in the area between the front volume and the MEMS sound transducer. Therefore, the penetration of dust and/or moisture can be prevented.

Furthermore, the dust barrier and/or the moisture barrier can be adhered to the transducer housing.

It is advantageous when the sound transducer unit comprises at least a second MEMS sound transducer, wherein one of the two MEMS sound transducers is operable as a loudspeaker and the other MEMS sound transducer is operable as a microphone. As a result, sound waves can be generated and, in particular simultaneously, detected.

It is advantageous when the two MEMS sound transducers are arranged next to one another on the circuit board. As a result, the two MEMS sound transducers can be arranged in a space-saving manner.

Alternatively, one of the two MEMS sound transducers can be arranged on the other MEMS sound transducer. For example, the MEMS sound transducer operated as a microphone is arranged on the MEMS sound transducer operated as a loudspeaker.

It is advantageous when the circuit board comprises a pressure compensation opening. The pressure compensation opening can be arranged next to the at least one MEMS sound transducer. Furthermore, with the aid of the pressure compensation opening, the front volume and the rear volume are connected to one another. A pressure between the front volume and the rear volume is equalized as a result.

It is advantageous when a dam arrangement is arranged around the pressure compensation opening. Consequently, adhesive, which is utilized, for example, for adhering the circuit board to the transducer housing, is prevented from entering the pressure compensation opening and, as a result, closing it.

Moreover, the invention relates to a method for manufacturing a sound transducer unit, in particular for an in-ear headphone, for generating and/or detecting sound waves in the audible wavelength spectrum and/or in the ultrasonic range.

The sound transducer unit can be designed according to at least one feature of the preceding description and/or the following description.

In the method, at least one MEMS sound transducer is placed onto a circuit board.

Moreover, in the method, at least one connector element of the MEMS sound transducer is electrically connected to at least one contact element of the circuit board. As a result, an electrical connection is formed between the circuit board and the MEMS sound transducer.

According to the invention, the at least one MEMS sound transducer is designed as a surface-mount device, which is connected to the circuit board with the aid of surface-mount technology. With the aid of the surface-mount technology, the MEMS sound transducer can be placed onto the circuit board in an automated manner. The electrical connection of the circuit board to the MEMS sound transducer can also be carried out in an automated manner. Consequently, the manufacturing method can be simplified.

The invention also relates to a sound-generating unit comprising a sound transducer unit for generating and/or detecting sound waves in the audible wavelength spectrum and/or in the ultrasonic range. The sound-generating unit can be, for example, an in-ear headphone, a smartphone, a telephone, and/or a music system. The sound-generating unit can also be another mobile device.

According to the invention, the sound transducer unit is designed according to at least one feature of the preceding description and/or the following description. Additionally or alternatively, the sound transducer unit can be designed according to at least one feature of the preceding description and/or the following description.

In addition, it is advantageous when the sound-generating unit comprises an ear element, which is arranged in a first coupling region of the sound transducer unit. The ear element is, for example, an earplug. The ear element is designed to be flexible, for example, it is also rubber, so that it can adapt to an ear canal when it is inserted therein. The sound-generating unit is an in-ear headphone in this case.

Additionally or alternatively, the sound-generating unit comprises a headphone unit, which is arranged in a second coupling region of the sound transducer unit. The headphone unit can comprise, for example, a battery and/or an accumulator. The sound-generating unit is also an in-ear headphone in this case.

BRIEF DESCRIPTION OF THE DRAWINGS

Further advantages of the invention are described in the following exemplary embodiments. Wherein:

FIG. 2 is cut along the line B-B but with the addition of a transducer housing and other components.

DETAILED DESCRIPTION OF EXEMPLARY EMBODIMENTS

Figure 1:
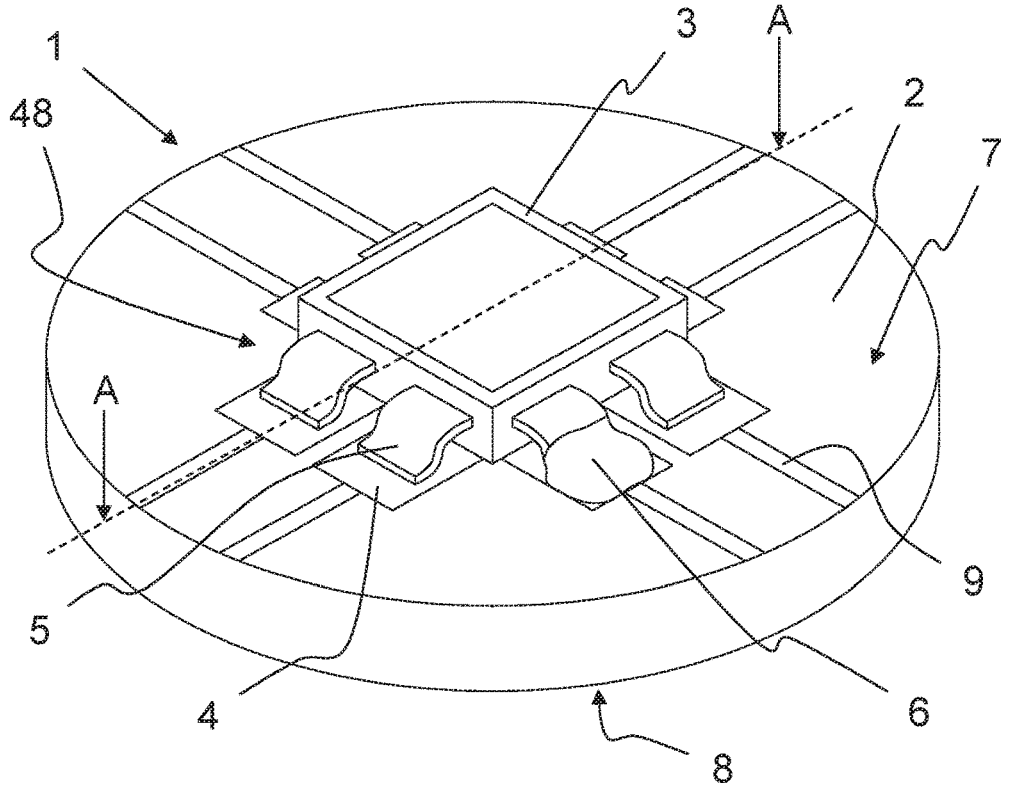
FIG. 1 shows a perspective, schematic view of a sound transducer unit comprising a circuit board and a MEMS sound transducer.

FIG. 1 shows a perspective, schematic view of a sound transducer unit 1 comprising a circuit board 2 and a MEMS sound transducer 3 mounted onto the circuit board 2. The dashed line and the arrows designated A-A schematically indicate where the sound transducer 1 pf FIG. 1 might be cut through this center line and reveal a sectional view shown in FIG. 5 for example. With the aid of the MEMS sound transducer 3, sound waves can be generated and/or detected. When the sound waves are generated, the MEMS sound transducer 3 or the sound transducer unit 1 is operated as a loudspeaker. Additionally or alternatively, the MEMS sound transducer 3 or the sound transducer unit 1 can also be operated as a microphone, so that the sound waves are detected.

Figure 7:
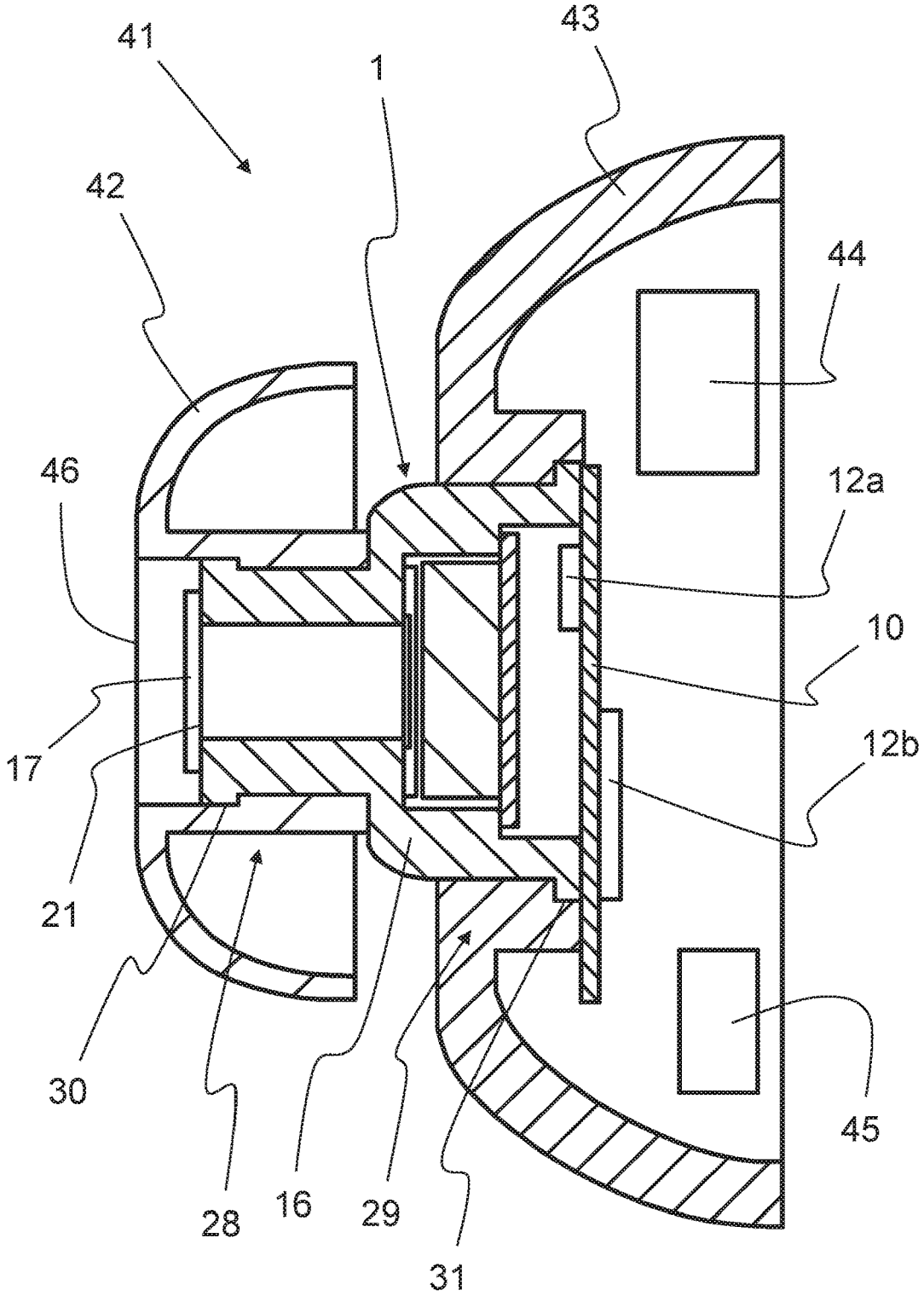
FIG. 7 shows an in-ear headphone depicted in a lateral sectional view taken similar to the way

Furthermore, the sound transducer unit 1 can be utilized for a sound-generating unit 41, which is designed as an in-ear headphone 41, by way of example, in FIG. 7.

Furthermore, in the present exemplary embodiment, the circuit board 2 comprises at least one connector element 4. In FIG. 1 shown here, only one connector element 4 is provided with a reference number, for the sake of clarity, although the circuit board 2 comprises multiple connector elements 4 in this case. The connector element 4 can be designed as a terminal area, as shown here. The connector element 4, in particular the terminal area, is arranged on and/or at a component side 7 of the circuit board 2. Furthermore, the circuit board 2 comprises an underside 8 positioned opposite the component side 7.

Moreover, the MEMS sound transducer 3 comprises at least one contact element 5, which is designed as a contact foot in this case. For the sake of clarity, once again, only one contact element 5 is provided with a reference number in FIG. 1, although the MEMS sound transducer 3 comprises multiple contact elements 5. The plurality of contact elements 5 are arranged in such a way that one contact element 5 rests on a respective connector element 4 in each case when the MEMS sound transducer 3 is mounted on the component side 7.

According to the invention, the MEMS sound transducer 3 is designed as a surface-mount device, which is connected to the circuit board 2 with the aid of surface-mount technology. Consequently, a respective connector element 4 is assigned to each respective contact element 5, so that the connector element 4 and the contact element 5 can form a respective electrical connection.

According to the present exemplary embodiment shown in FIG. 1, a contact element 5 is connected to the assigned connector element 4 with the aid of a soldered connection 6, so that the electrical connection is formed. For the sake of clarity in this case as well, only the soldered connection 6 between a single contact element 5 and a single connector element 4 is shown. Of course, a soldered connection 6 can exist between all contact elements 5 and the particular assigned connector element 4. Instead of the soldered connection 6, another integral connection also can be formed between the connector element 4 and the contact element 5. The connection is an electrical connection in this case.

With the aid of the surface mounting technology, the MEMS sound transducer 3 can be connected to the circuit board 2 in an automated and fast manner.

Furthermore, as shown in FIG. 1 for example, the circuit board 2 comprises a plurality of strip conductors 9, wherein, once again, only one strip conductor 9 is provided with a reference number for the sake of clarity. Each respective one of the plurality of strip conductors 9 is electrically connected to a respective one of the plurality of connector elements 4. Furthermore, the strip conductors 9 are merely schematically shown. The strip conductors 9 can converge and/or extend in parallel. Furthermore, one or more of the strip conductors 9 can extend through the circuit board 2 onto the underside 8.

Furthermore, as shown in FIG. 1 for example, the circuit board 2 comprises a contact region 48, in which the MEMS sound transducer 3 is or can be arranged. The connector elements 4 are preferably arranged in the contact region.

Figure 2:
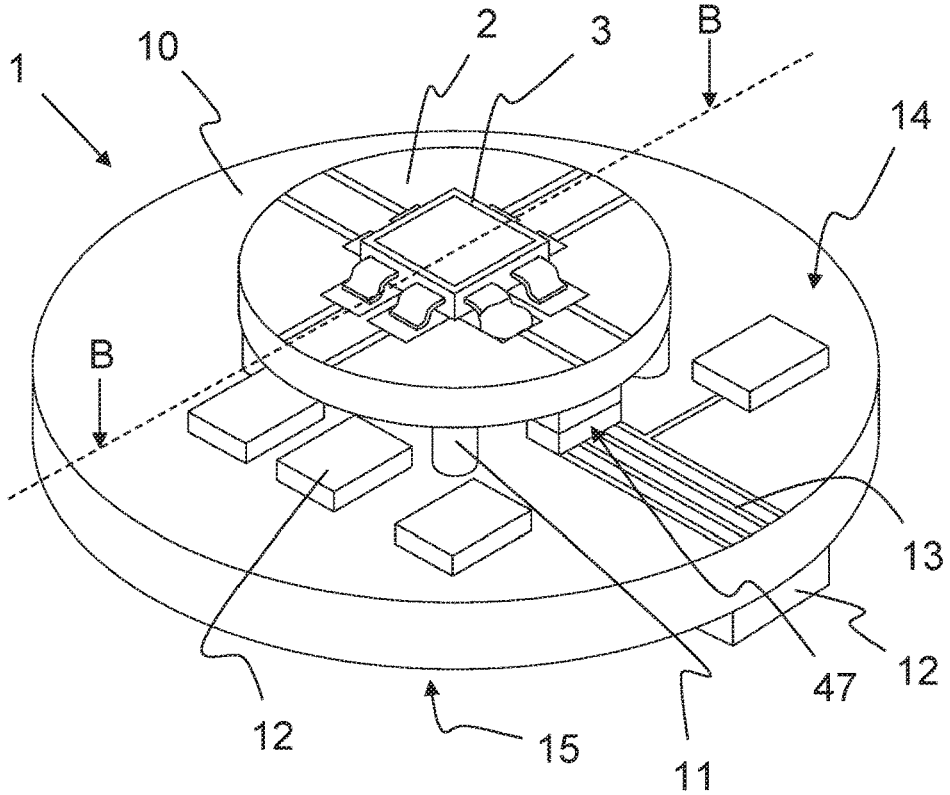
FIG. 2 shows a perspective, schematic view of a sound transducer unit comprising a circuit board and a MEMS sound transducer on a printed wiring board.

FIG. 2 shows a perspective, schematic view of a sound transducer unit 1 comprising a circuit board 2 and a MEMS sound transducer 3 mounted on a printed wiring board 10. The dashed line and the arrows designated B-B schematically indicate where the sound transducer 1 and wiring board 10 of FIG. 2 might be cut through this center line and reveal a sectional view schematically shown in FIGS. 3*a* and 3*b* for example.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features can also be described herein for the first time in the following figures.

The circuit board 2 and the MEMS sound transducer 3 arranged thereon are arranged on the printed wiring board 10 in this case shown in FIG. 2. The printed wiring board 10 is larger than the circuit board 2. Therefore, further components required for the operation of the sound transducer unit 1 can be arranged on the printed wiring board 10. The printed wiring board 10 desirably is also a main board.

According to the present exemplary embodiment of FIG. 2, the circuit board 2 is arranged on the printed wiring board 10 with the aid of spacers 11. The spacers 11 space the circuit board 2 apart from the printed wiring board 10.

The printed wiring board 10 comprises a printed wiring board top side 14 and a printed wiring board underside 15 positioned opposite thereto. The circuit board 2 is arranged on the printed wiring board top side 14. Furthermore, electronic components 12 desirably are arranged on the printed wiring board top side 14, wherein, for the sake of clarity, not all electronic components 12 are provided with a reference number. The electronic components 12 can be, for example, control units, memory units, resistors, coils, capacitors, radio modules, and/or sensors. Furthermore, the printed wiring board 10 comprises strip conductors 13, four being shown by way of example in side-by-side parallel arrangement in FIG. 2. With the aid of the strip conductors 13, all components are electrically connected to one another. Additionally or alternatively, one electronic component 12, which is schematically shown here, also can be arranged desirably at the printed wiring board underside 15. The printed wiring board 10 also can be a PCB (printed circuit board).

According to the present exemplary embodiment, the circuit board 2 and the printed wiring board 10 are designed to be disks with a round perimeter and are arranged coaxially to one another.

In order to be able to exchange electrical signals between the circuit board 2 and the printed wiring board 10, the present exemplary embodiment comprises a plug connection 47.

Additionally or alternatively, the electrical signals also can be conducted through the spacers 11. For example, at least one electrical supply voltage can be conducted through the spacers to the MEMS sound transducer 3 or other components.

Figure 3A:
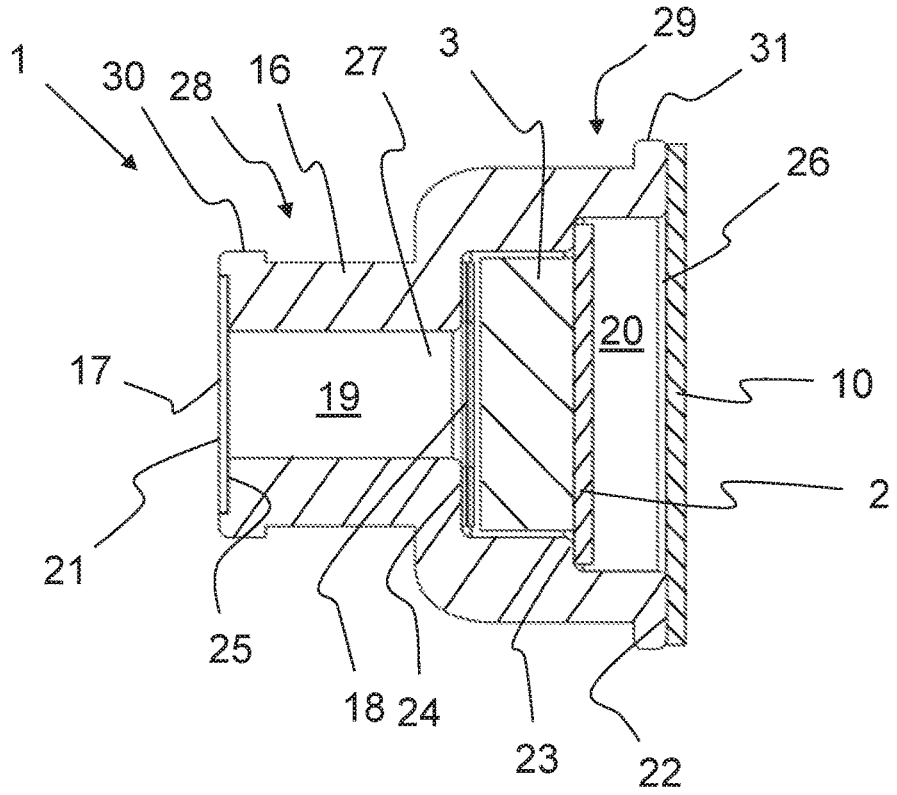
FIG. 3*a* shows a lateral sectional view taken along the line B-B in FIG. 2 but with the addition of a transducer housing.
Figure 3B:
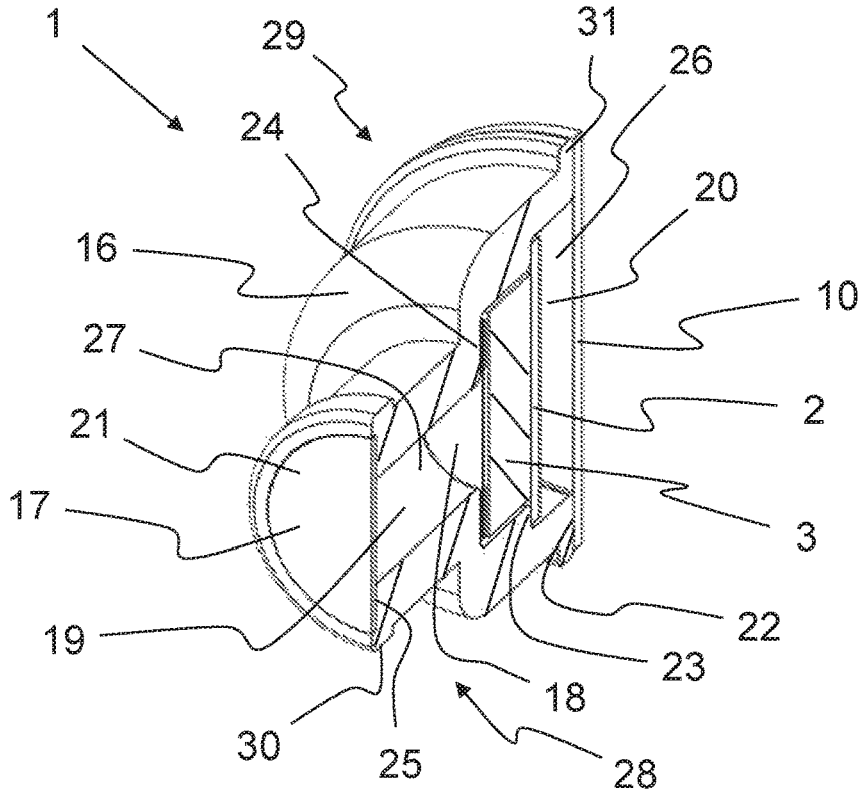
FIG. 3*b* shows a perspective sectional view of FIG. 3*a*.

FIGS. 3*a* and 3*b* show the sound transducer unit 1 comprising a transducer housing 16 in a lateral sectional view (FIG. 3*a*) and in a perspective view (FIG. 3*b*). In the sectional view from FIG. 3*a*, the sectional surfaces are represented with cross-hatching.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features can also be described herein for the first time in the following figures.

As shown in FIGS. 3*a* and 3*b*, at least the MEMS sound transducer 3 and/or the circuit board 2 are/is arranged in the transducer housing 16, so that at least the MEMS sound transducer 3 is protected against dirt and damage.

Furthermore, the printed wiring board 10 is also shown, wherein the circuit board 2, comprising the spacers 11 shown in FIG. 2 but not here in FIGS. 3*a* and 3*b*, is arranged on the printed wiring board 10.

The transducer housing 16 comprises an exit opening 21, through which the sound waves can emerge from the transducer housing 16 and/or enter the transducer housing 16. When the sound transducer unit 1 is utilized for an in-ear headphone, the exit opening 21 faces into the ear canal when the in-ear headphone is worn by a wearer.

As shown in FIGS. 3*a* and 3*b* for example, an insertion opening 26 is arranged on the side of the transducer housing 16 opposite the exit opening 21, through which the MEMS sound transducer 3 and/or the circuit board 2 can be inserted into the transducer housing 16 or an interior space 27 of the transducer housing 16.

The interior space 27 is delimited by the transducer housing 16 and the exit opening 21 and the insertion opening 26.

According to the present exemplary embodiment shown in FIGS. 3*a* and 3*b* for example, the printed wiring board 10 is designed to be larger than the insertion opening 26. The printed wiring board 10 closes the insertion opening 26.

Furthermore, as shown in FIGS. 3*a* and 3*b* for example, the transducer housing 16 desirably comprises a first base arrangement 22, onto which the printed wiring board 10 can be placed. The first base arrangement 22 borders the insertion opening 26.

Furthermore, the transducer housing 16 desirably comprises a second base arrangement 23, which is arranged in the interior space 27 and onto which the circuit board 2 can be placed via seating of a peripheral edge section of the circuit board 2 on the second base arrangement 23.

In addition, as shown in FIGS. 3*a* and 3*b* for example, the transducer housing 16 comprises a third base arrangement 24, which is arranged in the interior space 27 and onto which a moisture barrier 18 can be placed via seating of a peripheral edge section of the moisture barrier 18 on the third base arrangement 24. The moisture barrier 18 is arranged between the exit opening 21 and the MEMS sound transducer 3 in this case, so that the MEMS sound transducer 3 is protected against moisture that can enter through the exit opening 21. The moisture barrier 18 can be, for example, a diaphragm, which holds moisture back but allows sound waves to pass through.

Moreover, as shown in FIGS. 3*a* and 3*b* for example, the transducer housing 16 comprises a fourth base arrangement 25, onto which a dust barrier 17 can be placed via seating of a peripheral edge section of the dust barrier 17 on the fourth base arrangement 25. With the aid of the dust barrier 17, dust and/or dirt can be prevented from entering the interior space 27 of the transducer housing 16.

As shown in FIGS. 3*a* and 3*b* for example, when the MEMS sound transducer 3 and/or the circuit board 2 are/is arranged in the transducer housing 16, they subdivide the interior space 27 into a front volume 19 and a back volume 20. The front volume 19 is arranged between the exit opening 21 and the MEMS sound transducer 3. The back volume 20 is arranged between the MEMS sound transducer 3 and the insertion opening 26 or the printed wiring board 10. The spacers 11 (not shown here) desirably are at least partially arranged in the back volume 20.

According to the exemplary embodiment shown in FIG. 3*b*, it is apparent that the transducer housing 16 is designed to be rotationally symmetrical. Accordingly, the exit opening 21, the dust barrier 17, the printed wiring board 10, the circuit board 2, and/or the four base arrangements 22-25 are designed with circular symmetry. The interior space 27 is also rotationally symmetrical.

Furthermore, as shown in FIGS. 3*a* and 3*b* for example, a portion of the exterior surface of the transducer housing 16 desirably defines a first coupling region 28. An ear element 42, which is described further below and shown in FIG. 7, can be engaged with the first coupling region 28. The ear element 42 is advantageously flexible and/or made of rubber, so that it can be inserted into an ear canal of the wearer, wherein it adapts to the inner contour of the ear canal. With the aid of the ear element 42, a wearing comfort of the in-ear headphone 41 can be improved when the sound transducer unit 1 is utilized therefor.

Furthermore, as shown in FIGS. 3*a* and 3*b* for example, the transducer housing 16 comprises a first projection 30. The first projection 30 is configured so as to prevent the ear element 42 from slipping off the transducer housing 16 when the ear element 42 is arranged in the first coupling region 28. The first projection 30 is adjacent to one end of the first coupling region 28.

Furthermore, as shown in FIGS. 3*a* and 3*b* for example, a portion of the exterior surface of the transducer housing 16 defines a second coupling region 29. A headphone unit 43, which is described further below and shown in FIG. 7, can be placed into and engage the second coupling region 29. The headphone unit 43 comprises the elements that are required in addition to the sound transducer unit 1 when the sound transducer unit 1 is utilized in an in-ear headphone 41. Such elements are, for example, an energy store 44, a charging socket for charging the energy store 44, and/or additional sensors 45 as schematically shown in FIG. 7.

Furthermore, as shown in FIGS. 3*a* and 3*b* for example, the transducer housing 16 defines a second projection 31. The second projection 31 is configured so as to prevent the headphone unit 43 from slipping off the transducer housing 16 when the headphone unit 43 is arranged in the second coupling region 29. The second projection 31 is adjacent to one end of the second coupling region 29.

Furthermore, the first coupling region 28 and/or the second coupling region 29 are/is designed to be formed as cylindrical surfaces.

Figure 4:
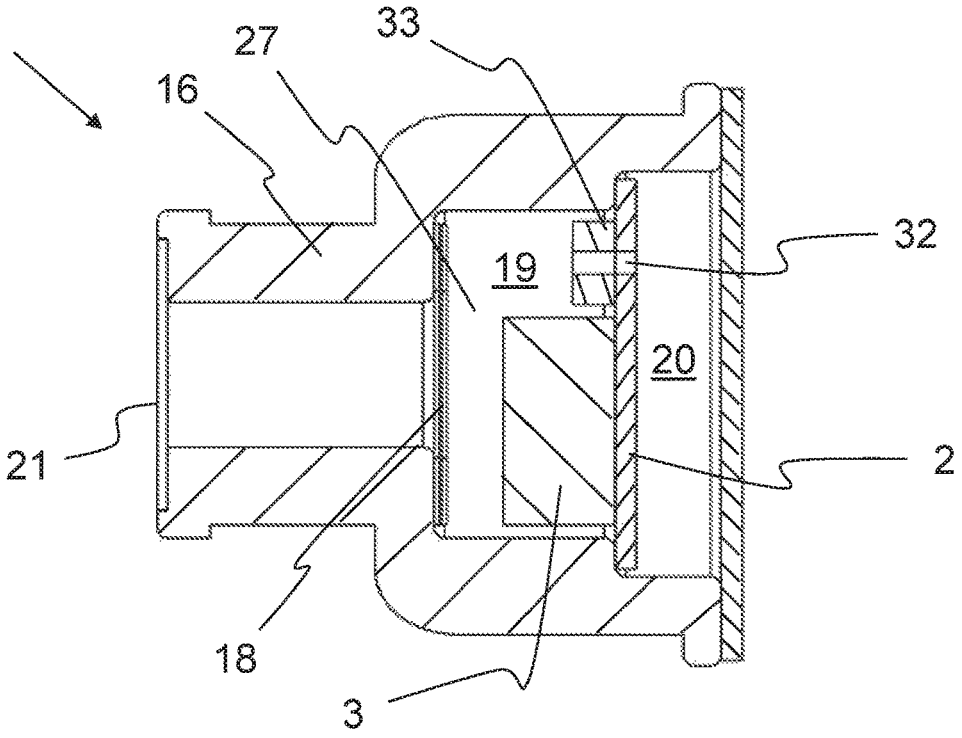
FIG. 4 shows a lateral sectional view of another sound transducer unit taken along the line B-B in FIG. 2 but with the addition of a transducer housing, a pressure compensation opening and other components not shown in FIG. 2.

FIG. 4 shows a lateral sectional view of a sound transducer unit 1 comprising a pressure compensation opening 32. The sectional surfaces are once again represented with cross-hatching.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features also can be described herein for the first time in the following figures. In addition, the features that are already known from the preceding figures have not been provided with a reference number once again.

As shown in FIG. 4, the circuit board 2 and/or the MEMS sound transducer 3 subdivide/subdivides the interior space 27 into the front volume 19 and the back volume 20. The front volume 19 extends from the circuit board 2 and/or the MEMS sound transducer 3 up to the exit opening 21, i.e., preferably also through the moisture barrier 18. With the aid of the pressure compensation opening 32, a pressure difference between the front volume 19 and the back volume 20, which arises when the MEMS sound transducer 3 is operated, can be equalized. The pressure compensation opening 32 desirably can have a diameter that is less than 0.5 mm. At such a magnitude, the pressure compensation opening 32 is essentially impermeable to sound waves, yet the pressure difference can equalize, however. The pressure compensation opening 32 is arranged in the circuit board 2 in this case, wherein multiple pressure compensation openings 32 would also be conceivable.

As shown in FIG. 4, the pressure compensation opening 32 desirably is bordered by a dam arrangement 33 in this case. The dam arrangement 33 desirably is formed as a cylindrical sleeve that projects from one side of the circuit board 2 and into the front volume 19 and defines a central channel that is aligned with and concentric with the pressure compensation opening 32. With the aid of the dam arrangement 33, adhesive can be prevented from entering the pressure compensation opening 32 when the circuit board 2 is adhered to the transducer housing 16.

Figure 5:
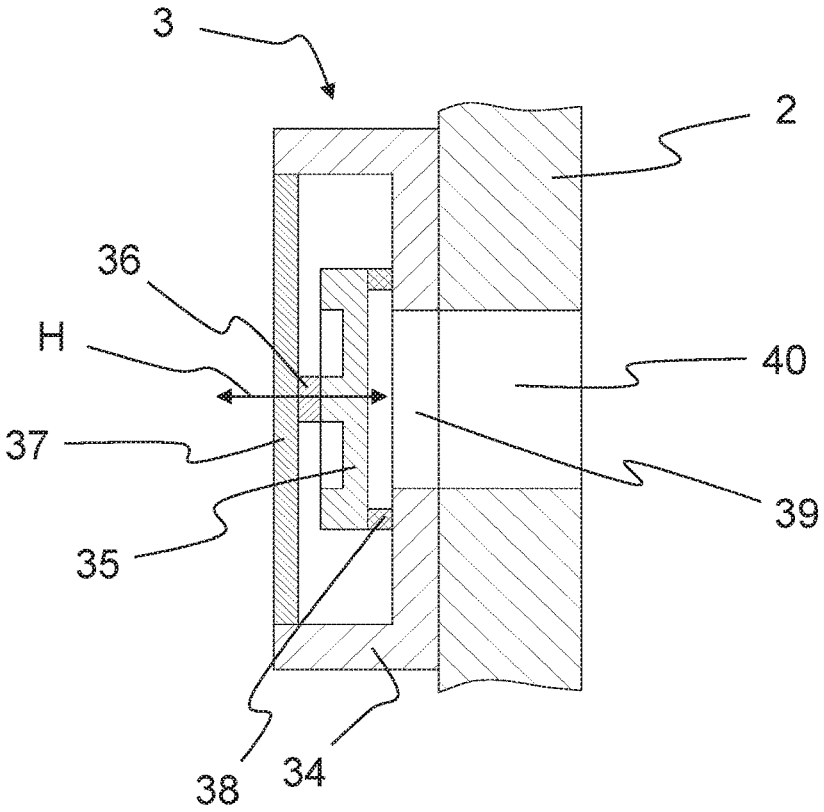
FIG. 5 shows a lateral sectional view of the MEMS sound transducer comprising a section of the circuit board taken along the line A-A in FIG. 1.

FIG. 5 shows a sectional view of the MEMS sound transducer 3 comprising a section of the circuit board 2. The MEMS sound transducer 3 is shown in greater detail in this view.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features can also be described herein for the first time in the following figures. In addition, the features that are already known from the preceding figures have not been provided with a reference number once again.

As shown in FIG. 5, the MEMS sound transducer 3 comprises a transducer support 34, which can be designed as a transducer substrate. With the aid of the transducer support 34, the MEMS sound transducer 3 rests on the component side 7 (FIG. 1) of the circuit board 2.

As shown in FIG. 5, a transducer element 35 is arranged on the transducer support 34 with the aid of base elements 38. The transducer element 35 can comprise at least one piezoelectric actuator and/or at least one piezoelectric layer, so that the transducer element 35 can convert electrical signals into deflections and/or deflections into electrical signals. When the electrical signals are converted into deflections, the MEMS sound transducer 3 is operated as a loudspeaker. When the deflections are converted into electrical signals, the MEMS sound transducer 3 is operated as a microphone. The electrical signals can be audio signals.

Furthermore, as shown in FIG. 5, the MEMS sound transducer 3 comprises a diaphragm unit 37, which is coupled to the transducer element 35 with the aid of a coupling element 36. Deflections can therefore be exchanged between the diaphragm unit 37 and the transducer element.

With the aid of the diaphragm unit 37, the air situated above the diaphragm unit 37 can be caused, by the deflections initiated by the transducer element 35, to vibrate, so that sound waves are generated. Accordingly, the MEMS sound transducer 3 is operated as a loudspeaker. By comparison, sound waves can also cause the diaphragm unit 37 to vibrate, which results in deflections of the diaphragm unit 37. The deflections are converted into electrical signals by the transducer element 35. Consequently, the MEMS sound transducer 3 is operated as a microphone. With the aid of the circuit board 2 and/or the printed wiring board 10, the audio signals can be conducted to the MEMS sound transducer 3 and/or conducted away therefrom.

The aforementioned deflections have a direction along a stroke axis H schematically shown by the double-headed arrow in FIG. 5. The transducer element 35 and the diaphragm unit 37 are also deflected along the stroke axis H.

Furthermore, as shown in FIG. 5, a first through-channel 39 is arranged in and defined by the transducer support 34. A second through-channel 40 is arranged in and defined by the circuit board 2. The two through-channels 39, 40 are arranged coaxially and congruently with respect to one another. The two through-channels 39, 40 form an equalizing channel. When the diaphragm unit 37, which is preferably closed, deflects along the stroke axis H, a fluctuating under-pressure and over-pressure arises on the side facing the circuit board 2 in the area of the transducer element 35 and/or the diaphragm unit 37. This pressure fluctuation interferes with the movement of the diaphragm unit 37, however. With the aid of the first through-channel 39 and the second through-channel 40, a connection to the back volume 20 can be formed, so that the magnitude of the over-pressure and under-pressure can be diminished and the deflections of the diaphragm unit 37 can more accurately reflect the sounds that cause the deflections or are caused by the deflections. Thus, the two through-channels 39, 40 are utilized for improving the acoustics of the MEMS sound transducer 3.

Furthermore, the at least one contact element 5 shown in FIG. 1 for example can be arranged at the transducer support 34, which also can be preferably designed as a contact surface. The at least one contact element 5 can be arranged at an outer or peripheral side of the MEMS sound transducer 3 or the transducer support 34. Due to the at least one contact surface, the MEMS sound transducer 3 can be soldered directly onto the circuit board 2. Preferably, the MEMS sound transducer 3 or the transducer support 34 comprises multiple contact surfaces, which are appropriately arranged with respect to the connector elements 4.

Figure 6A:
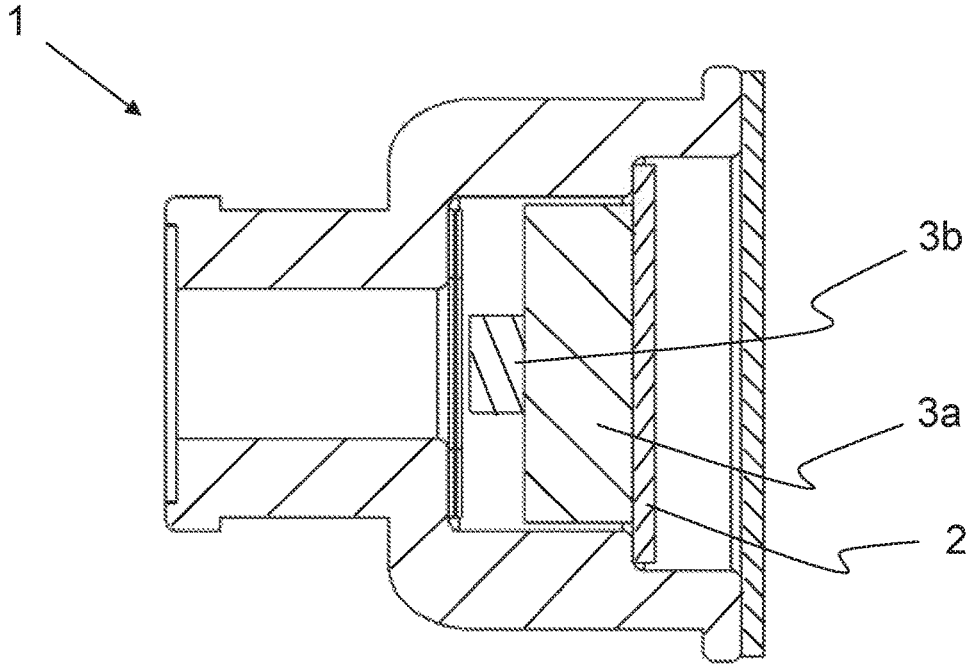
FIG. 6*a* shows a lateral sectional view of another sound transducer unit taken along the line B-B in FIG. 2 but with the addition of a transducer housing and a second MEMS sound transducer.
Figure 6B:
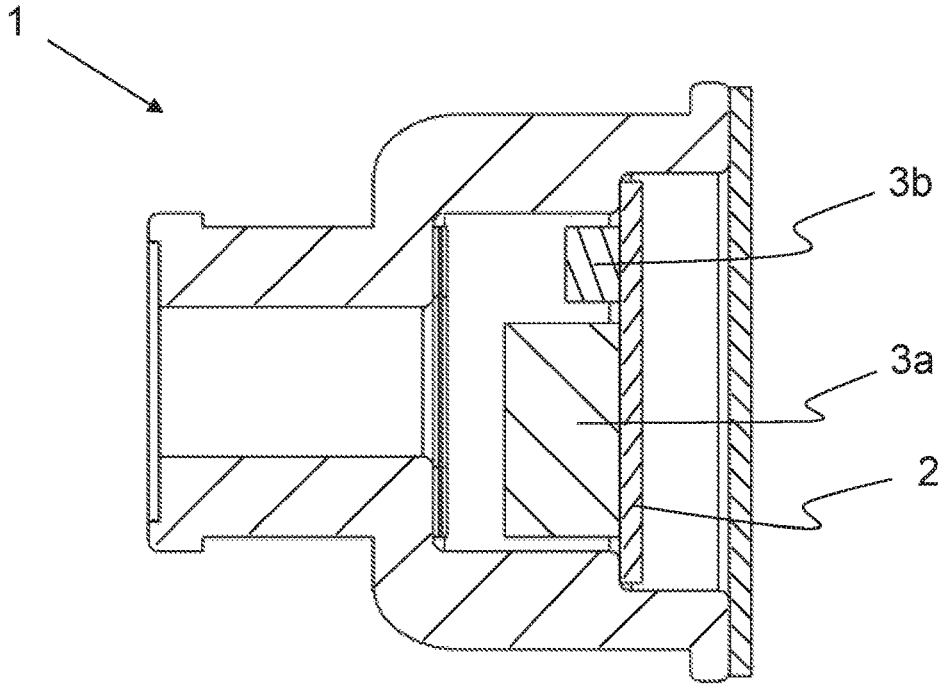
FIG. 6*b* shows a lateral sectional view of another sound transducer unit taken along the line B-B in FIG. 2 but with the addition of a transducer housing and a second MEMS sound transducer.

FIGS. 6*a* and 6*b* show a sound transducer unit 1 comprising, in each case, a second MEMS sound transducer 3*b*, in two different configurations.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features also can be described herein for the first time in the following figures. In addition, the features that are already known from the preceding figures have not been provided with a reference number once again.

The functions of the two MEMS sound transducers 3*a*, 3*b* are described with reference to FIG. 5.

When the sound transducer unit 1 comprises two MEMS sound transducers 3*a*, 3*b*, one MEMS sound transducer 3*a*, 3*b* can be operated as a loudspeaker and the other MEMS sound transducer 3*a*, 3*b* can be operated as a microphone. As a result, the sound transducer unit 1 can be operated, either sequentially or simultaneously, as a loudspeaker and as a microphone.

In FIG. 6*a*, a MEMS sound transducer 3*b* is arranged on the other MEMS sound transducer 3*a*. This is advantageous when there is hardly any space available on the circuit board 2.

In FIG. 6*b*, the two MEMS sound transducers 3*a*, 3*b* are arranged next to one another side-by-side on the circuit board 2. This is advantageous when a height is to be limited.

FIG. 7 shows a lateral sectional view of an at least partially represented in-ear headphone 41. As an in-ear headphone 41, the sound transducer unit 1 is used mainly as a loudspeaker. The in-ear headphone 41 shown here is an example of a sound-generating unit 41. The sound transducer unit 1 can also be arranged, for example, in another device, such as a smartphone, a PC, etc.

Furthermore, features and their effect that have already been described with reference to the preceding figures are not explained once more, for the sake of simplicity. Furthermore, as compared to the preceding figures and/or the following figures, identical features or at least similarly acting features have the same reference numbers. For the sake of clarity, for example, features can also be described herein for the first time in the following figures. In addition, the features that are already known from the preceding figures have not been provided with a reference number once again.

In this FIG. 7, it is better shown that electronic components 12*a*, 12*b* can be arranged on both sides of the printed wiring board 10.

According to the present exemplary embodiment shown in FIG. 7, the ear element 42 is arranged in the first coupling region 28 of the transducer housing 16. The ear element 42, together with the first coupling region 28 and the first projection 30, forms a form-locking connection, so that the ear element 42 cannot slip off the transducer housing 16.

Furthermore, the ear element 42 defines an ear element opening 46, which, according to the present exemplary embodiment, is coaxial with the exit opening 21.

In the second coupling region 29, the headphone unit 43 is coupled to the transducer housing 16. The headphone unit 43, together with the second coupling region 29 and the second projection 31, forms a form-locking connection, so that the headphone unit 43 cannot slip off the transducer housing 16.

According to the present exemplary embodiment shown in FIG. 7, the headphone unit 43 comprises, by way of example, an energy store 44 and one further sensor 45. Of course, the headphone unit 43 can comprise even further components for the in-ear headphone 41.

Even though the sound transducer unit 1 is described in connection with the in-ear headphone 41 in this case, the sound transducer unit 1 also can be utilized for another mobile device. For example, the sound transducer unit 1 also can be incorporated as a component of a smartphone, a radio, a television, etc. The in-ear headphone 41 is an example of a mobile device.

The present invention is not limited to the represented and described exemplary embodiments. Modifications within the scope of the claims are also possible, as is any combination of the features, even if they are represented and described in different exemplary embodiments.

LIST OF REFERENCE NUMERALS

1 sound transducer unit
2 circuit board
3 MEMS sound transducer
4 connector element
5 contact element
6 soldered connection
7 component side
8 underside
9 strip conductor
10 printed wiring board
11 spacer
12 electronic component
13 strip conductor
14 printed wiring board top side
15 printed wiring board underside
16 transducer housing
17 dust barrier
18 moisture barrier
19 front volume
20 back volume
21 exit opening
22 first base arrangement
23 second base arrangement
24 third base arrangement
25 fourth base arrangement
26 insertion opening
27 interior space
28 first coupling region
29 second coupling region
30 first projection
31 second projection
32 pressure compensation opening
33 dam arrangement
34 transducer support
35 transducer element
36 coupling element
37 diaphragm unit
38 base element
39 first through-channel
40 second through-channel
41 in-ear headphone
42 ear element
43 headphone unit
44 energy store
45 sensor
46 ear element opening
47 plug connection
48 contact region
49
H stroke axis

What is claimed is:

1. A sound transducer unit for an in-ear headphone, for generating and/or detecting sound waves in the audible wavelength spectrum and/or in the ultrasonic range, the sound transducer unit comprising:

a printed wiring board;

a circuit board arranged above the printed wiring board and electrically connected on the printed wiring board and including a MEMS sound transducer and a connector element;

wherein the MEMS sound transducer is supported by a transducer support;

wherein the MEMS sound transducer is designed as a surface-mount device and includes a contact element electrically conductively connected to the connector element of the circuit board via the transducer support; and wherein the MEMS sound transducer is arranged on the circuit board and is connected to the circuit board with the aid of surface-mount technology.

2. The sound transducer unit as in claim 1, wherein the connector element and the contact element are electrically conductively connected to one another with the aid of an integral connection, in particular a soldered connection.

3. The sound transducer unit as in claim 1, wherein the MEMS sound transducer comprises a transducer element and a diaphragm unit, which is coupled to the transducer element of the M EMS sound transducer and which is made of a heat-resistant diaphragm material.

4. The sound transducer unit as in claim 1, wherein the transducer support comprises a first through-channel.

5. The sound transducer unit as in claim 1, wherein the at least one contact element is designed as a contact surface and/or that the at least one contact element is arranged at the transducer support and/or that the transducer support comprises electrical lines for the transducer element.

6. The sound transducer unit as in claim 1, wherein:

the transducer support is formed as part of the MEMS sound transducer and includes a first through-channel; and wherein the circuit board comprises a second through-channel, which is preferably coaxial and/or congruent with the first through-channel.

7. The sound transducer unit as in claim 1, wherein the circuit board comprises a component side facing the MEMS sound transducer, onto which the MEMS sound transducer is placed in a contact region, so that the contact element contacts the connector element.

8. The sound transducer unit as in claim 1, wherein at least one electrical plug connection is arranged between the circuit board and the printed wiring board, and/or that at least one spacer electrically connects the circuit board and the printed wiring board for exchanging electrical signals.

9. The sound transducer unit as in claim 1, wherein the sound transducer unit comprises a transducer housing, in which at least the MEMS sound transducer and/or the circuit board are/is arranged.

10. The sound transducer unit as in claim 9, wherein the transducer housing comprises a first coupling region for coupling an ear element to the transducer housing, and/or that the transducer housing comprises a second coupling region for coupling a headphone unit to the transducer housing.

11. The sound transducer unit as in claim 9, wherein the transducer housing comprises an exit opening for sound waves, and/or that the transducer housing comprises a front volume, which is arranged between the exit opening and the MEMS sound transducer.

12. The sound transducer unit as in claim 9, wherein the transducer housing comprises a dust barrier and/or a moisture barrier, wherein the dust barrier is preferably arranged in the area of the exit opening and/or the moisture barrier is arranged in the area between the front volume and the MEMS sound transducer.

13. The sound transducer unit as in claim 9, further comprising:

a dust barrier adhered to the transducer housing; and/or a moisture barrier adhered to the transducer housing.

14. The sound transducer unit as in claim 1, further comprising a second MEMS sound transducer, wherein one of the two MEMS sound transducers is operable as a loudspeaker and the other MEMS sound transducer is operable as a microphone.

15. The sound transducer unit as in claim 14, wherein the two MEMS sound transducers are arranged next to one another on the circuit board, or that one of the two MEMS sound transducers is arranged on the other MEMS sound transducer.

16. The sound transducer unit as in claim 1, wherein the circuit board comprises a pressure compensation opening, wherein a dam arrangement is arranged around the pressure compensation opening.

17. A method for manufacturing a sound transducer unit for an in-ear headphone, for generating and/or detecting sound waves in the audible wavelength spectrum and/or in the ultrasonic range, wherein the sound transducer includes a printed wiring board, a circuit board that includes a connector element and a MEMS sound transducer supported by a transducer support and including a contact element, the method comprising the steps of:

placing the MEMS sound transducer having the contact element onto the circuit board having the connector element;

electrically connecting the MEMS sound transducer to the connector element of the circuit board via the transducer support; and wherein the MEMS sound transducer is arranged on the circuit board with the aid of surface-mount technology; and electrically connecting the printed wiring board to the circuit board.

18. A sound-generating unit in an in-ear headphone, the sound-generating unit comprising:

a sound transducer unit for generating and/or detecting sound waves in the audible wavelength spectrum and/or in the ultrasonic range, the sound transducer unit including:

a printed wiring board;

a circuit board arranged above the printed wiring board and electrically connected on the printed wiring board and including a MEMS sound transducer and a connector element;

wherein the MEMS sound transducer is supported by a transducer support;

wherein the MEMS sound transducer is designed as a surface-mount device and includes a contact element electrically conductively connected to the connector element of the circuit board via the transducer support; and wherein the MEMS sound transducer is arranged on the circuit board and is connected to the circuit board with the aid of surface-mount technology.

19. The sound-generating unit as in claim 18, further comprising:

an ear element; and a headphone unit;

wherein the sound transducer unit includes a first coupling region in which the ear element is arranged, and wherein the sound transducer unit includes a second coupling region in which the headphone unit is arranged.

* * * * *